United States Patent [19]

Schmidt et al.

[11] Patent Number: 4,805,507

[45] Date of Patent: Feb. 21, 1989

[54] TIRE CUTTING MACHINE

[76] Inventors: Raymond H. Schmidt, R.R. 1, Box 238A, Buffalo, Minn. 55313; Wesley G. Sprunk, 6434 City West Parkway, Eden Prairie, Minn. 55344

[21] Appl. No.: 122,208

[22] Filed: Nov. 18, 1987

[51] Int. Cl.[4] ..... B26D 1/30

[52] U.S. Cl. ..... 83/601; 83/607; 83/694; 83/923; 83/925 R

[58] Field of Search ..... 83/345, 607, 609, 601, 83/605, 599, 928, 925 R, 694, 923, 564; 157/13

[56] References Cited

U.S. PATENT DOCUMENTS

| | | | |
|---|---|---|---|
| 363,524 | 5/1887 | Libbey | 83/605 |
| 1,028,690 | 6/1912 | Drury | 83/607 X |
| 2,496,018 | 1/1950 | Pearson | 83/607 |
| 2,563,741 | 8/1951 | Patton | 83/605 X |
| 4,300,425 | 11/1981 | Wozniak et al. | 83/607 X |
| 4,398,441 | 8/1983 | Jue | 83/607 X |
| 4,576,380 | 3/1986 | Shields | 83/605 X |

*Primary Examiner*—Frank T. Yost
*Assistant Examiner*—Rinaldi Rada
*Attorney, Agent, or Firm*—Orrin M. Haugen; Thomas J. Nikolai; Frederick W. Niebuhr

[57] ABSTRACT

A shear mechanism for cutting worn out vehicle tires into arcuate segments to facilitate storage and transportation. First and second vertically extending anvil members are mounted on a base in parallel, spaced-apart relationship to one another. The anvil members include removable female die members. Pivotally joined to the base is a blade member, the blade member also having a replaceable working edge. The blade is driven by a hydraulic ram and when a tire is positioned against the anvil and the ram is actuated, the blade will move into the gap between the spaced-apart anvil members and, in doing so, will sever through the side walls and tread surface of the vehicle tire.

5 Claims, 1 Drawing Sheet

TIRE CUTTING MACHINE

BACKGROUND OF THE INVENTION

I. Field of the Invention

This invention relates generally to shearing apparatus, and more particularly to a machine for cutting up worn-out automobile and other vehicle tires.

II. Discussion of the Prior Art

The disposal of wornout vehicle tires presents serious problems. First of all, if left outside, they tend to collect water which stagnates and forms a breeding site for insects, such as mosquitoes, which, of course, can be disease-carrying in many geographic locations. Furthermore, because tires occupy a substantial volume and are not biodegradable, disposal in landfills is inappropriate. Then, too, destruction by burning creates serious air and soil pollution problems.

Only recently, machines have been developed for tearing apart and grinding vehicle tire carcasses so that the synthetic rubber materials can be separated from the steel materials also used in present-day tire constructions. Processes have also been developed for recycling the synthetic rubber into other usable materials.

The machines used for tearing and grinding vehicle tires tend to be large and expensive. They require substantial power to operate and, thus, tend to be located at widely separated installations. As such, tires must be transported from the tire dealer's place of business to the site of the disposal machine. Given the hollow toroidal configuration of vehicle tires, shipment by truck or rail tends to be costly due to the bulky nature of the load and the inability to densely pack them. Then, too, the problem of collecting stagnant disease-breeding water remains throughout the collection, storage and transportation stages of disposal.

SUMMARY OF THE INVENTION

The present invention obviates the foregoing problems. Specifically, in accordance with the present invention, there is provided a power shear which may be used to initially cut up the used tire carcass into two or more arc segments and, when so cut, the segments can be packed one atop the other with the outside tread surface of one segment abutting the inside cord surface of the other. As such, the packing density is significantly increased, cutting down on transportation costs. Because the tires are severed radially into two or more segments, water does not tend to collect in the cut carcasses.

The tire shear in accordance with the present invention is sufficiently simple in its construction that it can be sold at a sufficiently low price that new tire dealers, service garages and the like can afford to have one on their premises. Thus, as old, worn tires are removed from vehicles and replaced with new ones, the old tires can immediately be cut up into circular segments and appropriately piled for storage and shipment.

The tire shear itself includes an elongated anvil comprising two spaced-apart bars mounted on a base or frame, and pivotally attached to the frame at the base of the bars is a movable shear member. Disposed between the shear and the frame is a hydraulic ram which, when actuated, moves the shear blade with great force into the gap between the two bars comprising the anvil. Prior to actuation, however, a tire carcass will be inserted between the blade and the anvil so that, when the two come together, the tire is effectively sheared in half.

To prevent the uncut tire from riding up on the shear blade as it is hydraulically driven to rotate the blade into the gap of the anvil, it has been found beneficial to provide a scalloped edge surface on the blade by forming semi-circular cut-outs at spaced-apart locations along the blade's cutting edge.

OBJECTS

It is accordingly a principal object of the present invention to provide a machine for cutting vehicle tires into plural arcuate segments.

Another object of the invention is to provide a rugged shear mechanism specifically designed for slicing through the width dimension of tires commonly used on automobiles, trucks and like vehicles.

A yet further object of the invention is to provide a shear mechanism for cutting worn out tires into more compact, easily transportable segments wherein the wear parts of the shear mechanism are readily replaceable.

A yet further object of the invention is to provide a shear mechanism comprising a base supporting a pair of laterally spaced anvil members and a pivotally mounted shear blade driven by a hydraulic actuator for forcing the cutting blade through a tire supported on the anvils and into the gap between the anvil members.

DESCRIPTION OF THE DRAWINGS

These and other objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
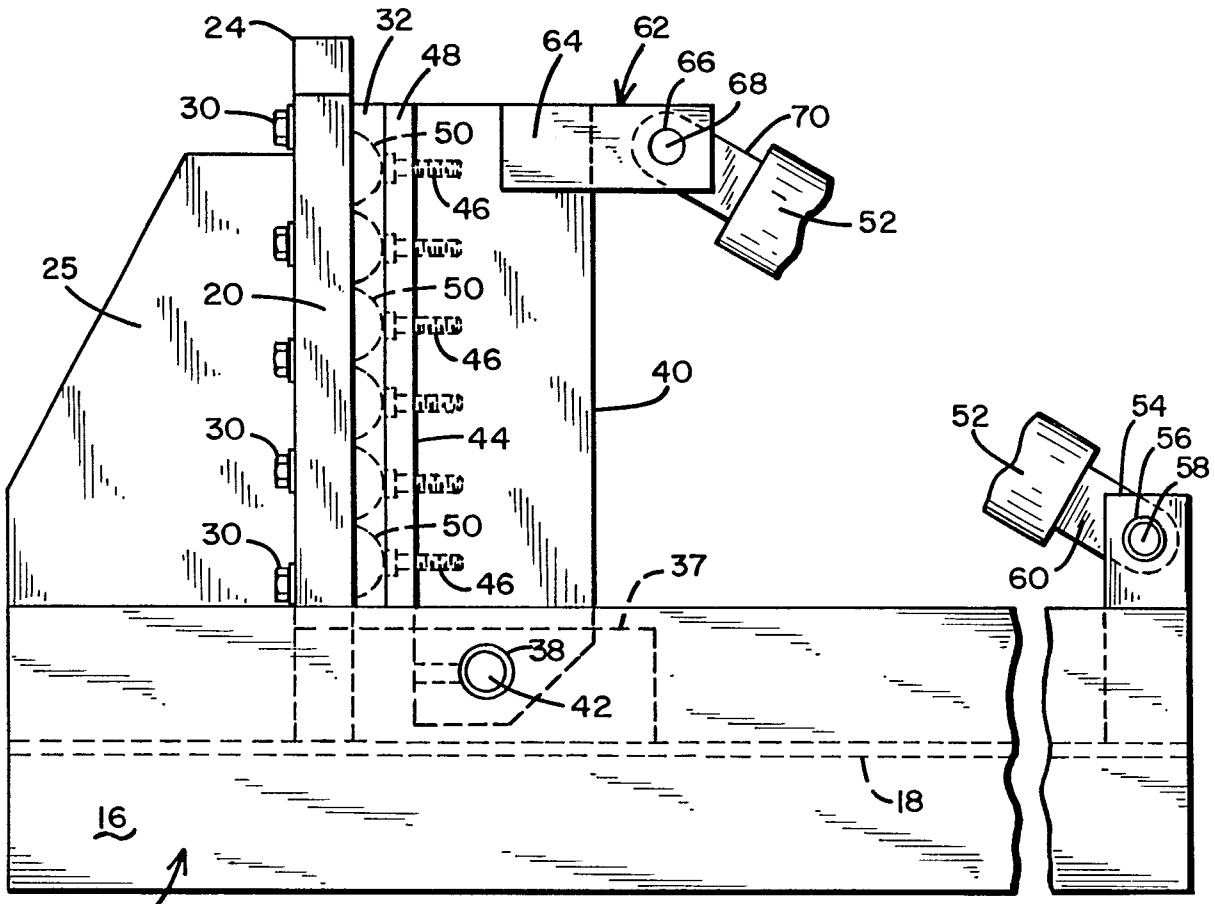
FIG. 1 is a side elevation of the tire cutting machine comprising the embodiment.

Referring to FIG. 1, the tire cutting machine of the present invention is indicated generally by numeral 10 and is seen to comprise a heavy steel beam 12 having a H-shaped cross-section including a left side plate 14 integrally joined to a right side plate 16 by a horizontal web 18. Welded to and projecting upwardly from the upper surface of the web 18 are first and second anvil support bars 20 and 22 which are joined together at their upper ends by a tie bar member 24. The anvil support bars 20 and 22 are reinforced in their vertical position by gusset plates 25 and 26 which are welded to the web 18 of the I-beam 12 as at 28.

Figure 2:
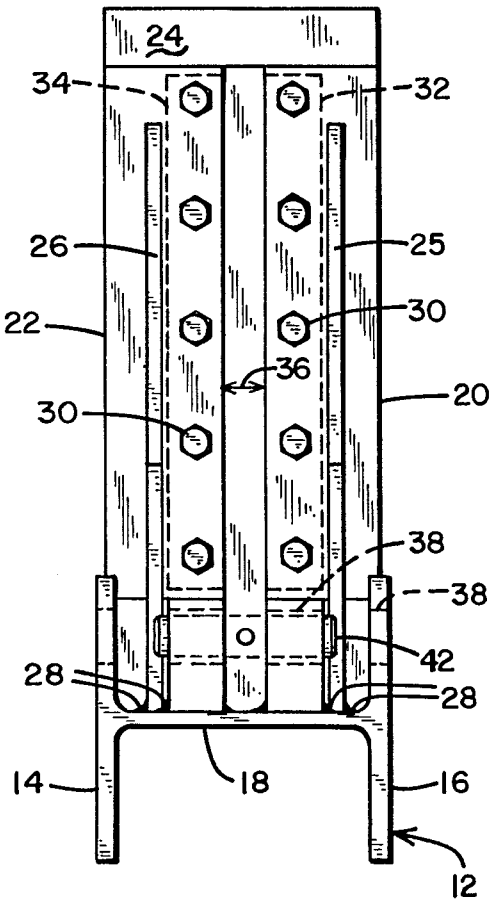
FIG. 2 is an end view of the embodiment of FIG. 1.

Affixed to the respective anvil support bars 20 and 22 as by bolts 30 are anvil die blocks 32 and 34. These die blocks are oriented vertically in parallel, spaced-apart relationship and with a gap indicated by doubled headed arrow 36 (FIG. 2) therebetween.

With reference to FIG. 1, to the right of the anvil support bars 20 and 22 and wedded in place on the web 18 of the I-beam 12 are a pair of shear anchor blocks 37 which are spaced apart from one another in parallel alignment. A circular bore 38 extends through the side walls 12 and 14 of the I-beam base as well as through the thickness dimension of the shear anchor block 37. A shear blade 40 is positioned between the anchor block 37 and it, too, has a bore formed through its thickness dimension whereby a pivot pin 42 may be inserted through the bore 38 to pivotally join the shear blade 40 to the base.

Secured to the working face 44 of the shear blade 40 as by cap screws 46 is a replaceable die block 48 whose width dimension is such that it fits with a minimum clearance in the gap 36 between the anvil members 32 and 34. As can be seen in the side elevation of FIG. 1, the working face of the shear die block 48 is scalloped along its length. More particularly, a series of semi-circular recesses 50 are cut into the face of the shear die block 48. A hydraulic cylinder indicated generally by numeral 52 is used to apply the cutting force to the vehicle tire when it is positioned between the scalloped working face of the replaceable die block 48 and the spaced-apart anvil members 32 and 34. More particularly, there is welded to the rightmost end of the base 12 a clevis connection comprising a pair of spacedapart anchor blocks 54 which are welded to the web 18 of the base. A circular hole 56 is drilled through the blocks 54 for receiving a pin 58 therethrough. The pin also passes through a bore (not shown) formed through a first end 60 of the hydraulic actuator 52. The other end of the hydraulic cylinder 52 is likewise coupled to the shear blade 40 by a clevis coupling 62. That is, a pair of parallel oriented anchor plates 64 are welded to the blade 40 and an aperture 66 passes through each so that a pin 68 may be used to secure the end 70 of the cylinder 52 to the anchor plates for rotational movement when the piston/cylinder of the actuator 52 is energized from a motor-driven hydraulic pump (not shown).

In use, the hydraulic piston is retracted into its cylinder causing the blade 40 to rotate clockwise when viewed in FIG. 1 about the pivot pin 42. When thus opened, a vehicle tire may be suspended on the anvil assembly by inserting one side wall of the tire over the tie bar 24 of the anvil with the balance of the tire extending downwardly along the front surface of the removable die blocks 32 and 34. Now, when the hydraulic cylinder is actuated so as to rotate the blade assembly in the counterclockwise direction (FIG. 1), the scalloped male die 48 will come into engagement with the tire casing and as the forces increased, shearing action takes place whereby the tire carcass is sliced radially as the die block 48 moves into the gap between the anvil blocks 32 and 34. The scalloped contour of the die block 48 inhibits any tendency for the tire to ride up the surface of the anvil as the pivoting blade assembly 40-48 is forced against it.

Because many present-day vehicle tires incorporate steel belts within the body of the tire casing, both the shear blade 48 and the anvil bars 32 and 34 are subject to wear with use. By making the anvil bars 32 and 34 removable and replaceable and by also having a replaceable working edge 48 on the shear blade 40, these wear parts can readily be removed and replaced when they become worn to the point where cutting performance is compromised.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. Tire shearing apparatus comprising:

(a) a base member;

(b) first and second anvil member affixed to said base member and projecting vertically upwardly therefrom, said anvil members being parallel to one another and spaced laterally by a predetermined distance to define a gap therebetween;

(c) a shear member in the form of an elongated bar of generally rectangular cross-section pivotally secured to said base member and centered in the space between said first and second anvil members and of a width less than said predetermined distance for rotation into and out of said gap, said bar having a working edge including a plurality of regularly spaced, non-intersecting semi-circular recesses along the length dimension thereof so as to inhibit any tendency of a tire to ride up the surfaces of the first and second anvils as the shear member is forced against the tire; and (d) reciprocally operating force applying means disposed between said shear member and said base member for causing said rotation of said shear member.

2. The shearing apparatus as in claim 1 wherein said working edge is removable from the remainder of said shear member.

3. The shearing apparatus as in claim 1 wherein said first and second anvil members each include removable die block members affixed thereto, said die blocks having a planar working face.

4. The tire shearing apparatus as in claim 1 wherein said force applying means comprises a hydraulic ram having a piston and cylinder, one of said piston and cylinder pivotally secured to said base member and the other of said piston and cylinder being pivotally joined to said shear.

5. The tire shearing apparatus as in claim 1 and further including first and second reinforcing gussets disposed between said first and second anvil members and said base member.

* * * * *